United States Patent [19]

Tyssee

[11] 4,028,201

[45] June 7, 1977

[54] ELECTROLYTIC MONOCARBOXYLATION OF ACTIVATED OLEFINS

[75] Inventor: Donald Armon Tyssee, St. Louis, Mo.

[73] Assignee: Monsanto Company, St. Louis, Mo.

[22] Filed: Nov. 13, 1972

[21] Appl. No.: 306,227

[52] U.S. Cl. ..... 204/72; 204/59 R; 204/73 R

[51] Int. Cl.[2] ..... C25B 3/00

[58] Field of Search ..... 204/59 R, 72, 73 R

[56] References Cited

UNITED STATES PATENTS

| | | | |
|---|---|---|---|
| 3,032,489 | 5/1962 | Loveland | 204/73 R |
| 3,193,478 | 7/1965 | Baiser | 204/73 |
| 3,344,045 | 9/1967 | Neikam | 204/59 R |
| 3,344,046 | 9/1967 | Neikam | 204/59 R |

OTHER PUBLICATIONS

Symposium on Electrochem. Conversion of Hydrocarbon Based Raw Materials, Div. of Pet. Chem, Inc., Chicago, Sept. 13–18, 1970, pp. B5 and B6 by Tsutsumi et al., printed by Sauls Lithograph Co., Inc., Washington, D. C. Aug. 1970.

*Primary Examiner*—F.C. Edmundson
*Attorney, Agent, or Firm*—Wendell W. Brooks; Joseph D. Kennedy; John D. Upham

[57] ABSTRACT

Olefinic nitriles, esters and amides are electrolytically mono-carboxylated in the presence of carbon dioxide and a proton donor.

13 Claims, No Drawings

ELECTROLYTIC MONOCARBOXYLATION OF ACTIVATED OLEFINS

BACKGROUND OF THE INVENTION

The present invention relates to the electrolytic carbonation of olefinic nitriles, esters and amides.

Carboxylic esters and derivatives are well known industrial chemicals, having such diverse uses as plasticizers, monomers for the preparation of polyesters by interaction with glycols, etc. It has previously been known that some types of unsaturated compounds are subject to reduction at the cathode. It has also been known that when relatively stable reduction intermediates are obtained because of substituents on the olefinic group, as in the case of benzalacetone, the intermediates will react with carbon dioxide to form carboxyl compounds; (see Wawzonek et al. J. electrochem. Soc., Vol 111, pages 324 to 328, (1964)). It has also been known that acrylonitrile can be dicarboxylated, although apparently in very poor yield, by electrolysis under specified conditions in dimethyl formamide., see Tsutsumi et al., Electrochemical Carboxylation of Olefins, abstract of paper presented at Division of Petroleum Chemistry, American Chemical Society, Chicago Meeting, Sept. 13–18, 1970.

SUMMARY OF THE INVENTION

The present invention concerns a procedure for electrolytic monocarboxylation of olefinic nitriles, esters and amides in which the reaction is moderated by protons to direct it toward monocarboxylation. Specifically, a low concentration of water is provided in the electrolysis medium to serve as a proton source.

DETAILED DESCRIPTION OF THE INVENTION

The course of the reaction of the present invention can be pictured:

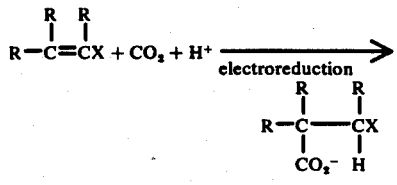

in which the Rs are individually selected from hydrogen, monovalent aliphatic radicals or X, and X is selected from

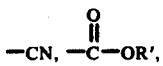

and

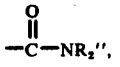

in which R' is a monovalent organic radical and the R''s are individually selected from monovalent organic radicals and hydrogen.

The present invention is particularly useful for obtaining monocarboxylated derivatives of alkenyl nitriles, e.g., 3-cycanopropionic acid from acrylonitrile. The reaction can be illustrated:

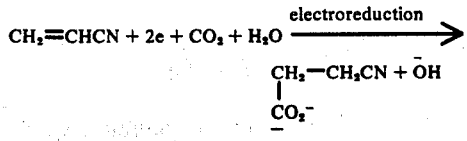

The reaction can conveniently be effected by providing a small concentration of water in the electrolysis medium as a proton source.

The carboxyl compounds produced in the present invention can be recovered in the form of free acid, esters or salts. With a fair amount of proton donor in the electrolysis, the product is generally in the form of the free acid, and can be separated by extraction, e.g. with ether, and evaporation of the extracting medium. If the product is in the form of a salt, it can be converted to the free acid by mild acidification, e.g., with dilute mineral acid, and isolated as such. Some products may exhibit a tendency to decarboxylation upon use of stringent conditions such as high temperatures and concentrated strong acids, so care should be exercised in such cases to avoid decarboxylation. In the procedures in which nitriles are employed, it will ordinarily be desirable to avoid conditions known to result in hydrolysis of the nitrile group, such as excessively acid or basic conditions with elevated temperatures. When a nitrile is the starting material, it will generally be desirable to retain the cyano group in the product and to obtain a $\beta$-cyanocarboxylic acid, rather than hydrolyze the nitrile group, as such products are less readily available from other sources than are the corresponding succinic acids which are obtained by the hydrolysis. However the present procedure is still to be considered operative even though hydrolysis does result in the production of a succinic acid. With respect to the olefinic esters and amides, it will be noted that such groups are also subject to hydrolysis and the foregoing also applies to reactions involving such compounds, although conversion from ester to free acid form may often be contemplated for a particular product. If it is desired, the carboxylated products can be converted to ester form by usual esterification procedures, e.g., by treatment with methyl iodide or dimethyl sulfate. The ester forms are amenable to separation by extraction procedures. The products may at times be found in salt form because of the presence of salts in the electrolysis, but, in any event, can be converted to salt form by treatment with bases, and the salts can frequently be isolated by aqueous solvent extraction.

The present procedure can be visualized as involving a mono-carboxylated intermediate:

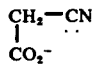

and the intermediate then adds protons to form:

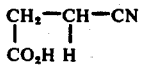

In the absence of protons it would add additional carbon dioxide to form a dicarboxyl product:

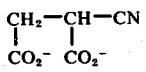

Thus it can be seen that the present invention involves directing the reaction to have a proton added to one of the carbons of the reactant in place of a carbon dioxide molecule, thereby resulting in a mono-carboxylation rather than dicarboxylation. The present procedure appears to involve an intermediate as illustrated above. However, regardless of the actual mechanism involved, the availability of protons results in directing the process toward monocarboxylation and the described procedure is included in the invention. It should also be recognized that carboxylation can occur on the alpha carbon atom rather than the beta carbon atom, and that mixtures of products can be produced.

The present process can use various sources of protons, but water is inexpensive and conveniently available. Moreover water is a useful component in electrolysis procedures for its conductivity. Mild mineral or organic acids can also, of course, provide a proton, as can various polar compounds, such as alcohols, phenols and similar compounds sometimes referred to as hydrogen donors. Of course it will ordinarily be desirable to avoid any compounds which tend to interfere in any way with the desired reaction, or to be readily subject to reduction by electric current, as any competing reactions tend to detract from the efficiency of the desired reaction.

It is an object of the present invention to provide sufficient proton donor to direct the reaction substantially toward mono-carboxylation, e.g., to avoid more than 10 or 15% or so of dicarboxylation of reactant molecules. Amounts of water in the range of 0.5 to 15% or so by weight of the electrolysis medium are generally suitable for this purpose, but larger or smaller concentrations may be indicated in some circumstances. In fact, so long as carboxylation occurs there is no real upper limit on the water concentration, but excessive amounts of water may tend to cause simple reduction of the olefinic bond rather than carboxylation. Ordinarily it will not be desirable to utilize amounts of water which result in conversion of more than 10 to 15% of the olefinic reactant to the saturated olefin, e.g., acrylonitrile to propionitrile. It will be recognized that the effect of particular water concentrations will vary somewhat with the concentrations of the olefinic reactant and $CO_2$ in the electrolysis medium, as well as with the current and potential employed. When proton donors other than water are employed, it will be desirable to adjust the concentrations of such materials to make allowances for their strength as proton donors in comparison to water.

The activated olefinic reactants employed herein will often be largely hydrocarbon in character, i.e., be alkenyl carboxylates, nitriles or amides, and the resulting carboxylates can be employed as detergent builders or as monomers for production of polyester resins (by reaction with glycols, etc.), or for production of polyamide resins. However it may at times be desirable to have various other groups present in the molecules, and the present process can be effected with various other substituents present in the olefinic reactants, including even such electron releasing heteroatoms as O, N, P and S bearing various substituents and attached to one of the olefinic carbon atoms. Of course such heteroatoms at more remote locations in the olefinic reactant will have little effect and reactants having such substituents can suitably be employed.

Alpha,beta-olefinic reactants to which the present invention is applicable include for example acrylonitrile, methacrylonitrile, crotonitrile, pentenenitrile, 2-methylenehexane-nitrile, 2,3-dimethylcrotonitrile, 2-ethylidenehexanenitrile, β-carbethoxyacrylonitrile, β-methoxyacrylonitrile, fumaronitrile, methyl acrylate, ethyl acrylate, ethyl crotonate, phenylethyl acrylate, ethyl 2-pentenoate, pentyl fumarate, diethyl maleate, ethyl 3-methoxyacrylate, acrylamide, N,N-diethylcrotonamide, N,N-diethylmethacrylamide, N,N-diphenylacrylamide, etc. The reaction results in production of a product corresponding to the reactant but with a carboxyl group substituted on the olefinic carbon atom beta to a nitrile, carbalkoxy, or amido group of the reactant, and with the olefinic bond becoming saturated. As discussed herein, the nitrile, carbalkoxy, or amido groups can also be reacted, if desired, to form other derivatives.

The present process is believed to involve reduction of the olefinic reactant and subsequent reaction with carbon dioxide. The types of activated olefins utilized herein are known to be subject to reduction to form radical anions as transitory intermediates. The intermediates which are formed are relatively short-lived and differ in this respect from other radical anions which are reactable with carbon dioxide. For example, phenyl or other aromatic substituents on an olefinic carbon atom are known to stabilize radical anions obtained by reduction of such olefins. In the present process it has been found unnecessary to have long-lived reduction intermediates, and aromatic substituents are not necessary in order to obtain carboxylation with the type of activated olefins employed herein. Aromatic substituents on carbon atoms other than those of the olefinic group will not in general affect the aliphatic character of the olefinic reactants in that the intermediates obtained can still be very short-lived and transitory, i.e., the aliphatic olefinic acid derivatives employed herein will not have any aryl groups in position to form conjugated double bond systems with the olefinic group.

The electrolysis is carried out by passing an electric current through the olefinic compound in contact with a cathode and in the presence of carbon dioxide. The olefinic compound or medium in which it is employed must have sufficient conductivity to conduct the electrolysis current. It is preferable from an economic viewpoint not to have too high a resistance. The required conductivity is generally achieved by employing common supporting electrolytes, such as electrolyte salts of sufficiently negative discharge potentials. Water when employed as a proton donor also contributes to conductivity.

The present reaction is preferably effected in the presence of a solvent for the olefin and the electrolyte. The electrolyte salts may not be readily soluble in the olefins. In addition, the solvents are useful as diluents in order to obtain desired ratios of reactants. Carbon dioxide at atmospheric pressure has only limited solubility in most of the olefins and solvents employed herein. If extensive dimerization or other oligomerization reactions are to be avoided, it is desirable not to have too great an excess of the olefinic reactant over the carbon dioxide. For example, the olefin concentration can be regulated so as not to be more than ten times the carbon dioxide concentration on a molar basis. To achieve this in reactions at atmospheric pressure the olefin concentration would ordinarily be no greater than one molar. Often it is convenient to add the olefin to the reaction medium in increments, or gradually as utilized in the reaction. In the event dimerization as well as carboxylation is desired, it may be desirable to utilize higher concentrations of olefins, even up to the complete absence of a solvent diluent.

It will generally be desirable for the solvents to have a fairly high dielectric constant in order to lower electrical resistance. Of course, the choice and concentration of electrolyte salts can also be used to lower electrical resistance. Solvents desirable for use herein include, for example, dimethylformamide, acetonitrile, hexamethylphosphoramide, dimethylsulfoxide, etc. In general it is desirable to employ a solvent with a dielectric constant of at least 25, and preferably of at least 50. Many of the useful solvents can be characterized as aprotic, and such solvents can suitably be utilized, particularly those of dipolar character which exhibit high dielectric constants. As discussed herein, the protonation, or lack of protonation, of intermediates has an effect upon the products produced in the present invention. Protonation is utilized in the present invention to direct the process toward particular products. Thus it is not essential to use aprotic solvents. However such solvents are convenient for controlling the proton-donating character of the electrolysis medium, as small amounts of water or other proton donors can be added to such solvents to achieve desired results.

While protons are utilized for controlling the degree of carboxylation, the presence of protons is not necessary for the purpose of avoiding polymerization or similar side reactions. The extent of dimerization and similar reactions is influenced by the concentration of reactants. In particular the relative concentration of carbon dioxide determines whether the olefinic intermediates react with carbon dioxide, or with other olefinic molecules. Since the degree of dimerization can be influenced by the relative carbon dioxide concentration, it is not generally necessary to use water for this purpose. Control of the cathode potential can also be used in some cases to influence the process toward or away from dimerization.

In the present process it is generally desirable to have the electrolyte, olefinic reactant and solvent in a fairly homogeneous dispersion. A true solution is not required as, for example, many quaternary ammonium salt solutions may, in some respects, be dispersions rather than true solutions. Thus the present invention may use emulsions as well as true solutions. Moreover in emulsions or media having more than one phase, electrolyses can occur in a solution of the components in one of the phases.

With the electrolyte and solvent materials usually employed, the catholyte will generally be approximately neutral, so far as acidity-basicity is concerned, and no particular provisions are necessary to regulate this parameter. However, it will usually be desirable to operate under near neutral conditions in order to avoid possibly promoting hydrolytic or other side reactions, or protonation of intermediates. Solubility and stability considerations with respect to the olefins and carboxylated products may also be relevant to selection of desirable pH values. In long term continuous reactions with re-use of catholyte media, it may be desirable to use buffers or to adjust pH periodically to desired values.

In carrying out the present process, a supporting electrolyte is generally used to enhance conductivity. With some combinations of activated olefins and solvents, an additional electrolyte may not actually be necessary, but in practice a supporting electrolyte is utilized in the present invention. A supporting electrolyte, as understood by those in the art, is an electrolyte capable of carrying current but not discharging under the electrolysis conditions. In the present invention this primarily concerns discharge at the cathode, as the desired reaction occurs at the cathode. Thus the electrolytes employed will generally have cations of more negative cathodic discharge potentials than the discharge potential of the olefinic compound. An electrolyte with a similar or slightly lower discharge potential that the olefinic compound may be operative to some extent, but yields and current efficiency are adversely affected, so it is generally desirable to avoid any substantial discharge of the electrolyte salt during the electrolysis. It will be recognized that discharge potentials will vary with cathode materials and their surface condition, and various materials in the electrolysis medium, and it is only necessary to have an effective reduction of the olefinic compound under the conditions of the electrolysis, and some salts may be effective supporting electrolytes under such conditions even though nominally of less negative discharge potential than the olefin employed.

In general any supporting electrolyte salts can be utilized in effecting the present process, with due consideration to having conditions suitable for the discharge of the olefinic compound involved. The term salt is employed in its generally recognized sense to indicate a compound composed of a cation and an anion, such as produced by reaction of an acid with a base. The salts can be organic, or inorganic, or mixtures of such, and composed of simple cations and anions, or very large complex cations and anions. Amine and quaternary ammonium salts are generally suitable for use herein, as such salts generally have very negative discharge potentials. Certain salts of alkali and alkaline earth metals can also be employed to some extent, although more consideration will have to be given to a proper combination of olefin and salt in order to achieve a discharge. Among the quaternary ammonium salts useful, are the tetraalkyl ammonium, e.g., tetraethyl or tetramethyl ammonium, methyltriethylammonium etc., heterocyclic and aralkyl ammonium salts, e.g., benzyltrimethylammonium, etc.

Various anions can be used with the foregoing and other cations, e.g. organic and inorganic anions, such as phosphates, halides, sulfates, sulfonates, alkylsulfate, etc. Aromatic sulfonates and similar anions, e.g., p-toluenesulfonates, including those referred to as McKee salts, can be used, as can other hydrotropic salts, although the hydrotropic property may have no particular significance when employed with very low water content. It is desirable to have some material present which is capable of a non-interfering discharge at the anode, and a small amount of water is generally suitable for this purpose. In general the salts disclosed in U.S. Pat. No. 3,390,066 of Manuel M. Baizer as suitable for hydrodimerization of certain allyl compounds, can also be employed in the present process, although the solubility considerations for solutions in water there discussed are not really essential to the present process. The concentration of salts, when used, can vary widely, e.g., from 0.5 to 50% or more by weight of the electrolysis medium, but suitable concentrations will often be in the range of 1 to 15% by weight, or on a molar basis, often in the range of 0.1 to 1 molar. If it is desired to have all the components in solution, the amount of salt utilized will then be no greater than will dissolve in the electrolysis medium.

In some cases under some conditions there may be advantages in using simple salts, such as lithium salts, and results may be comparable to or better than those obtainable with more complex salts. However, for general applicability and suitability at strongly negative discharge conditions, quaternary ammonium salts, or salts which discharge at more negative potential, than −2.2 cathodic volts versus the saturated calomel electrode, are preferred. The term quaternary ammonium is used herein in its generally recognized meaning of a cation having four organo radicals substituted on nitrogen.

Various current densities can be employed in the present process. It will be desirable to employ high current densities in order to achieve high use of electrolysis cell capacity, and therefore for production purposes it will generally be desirable to use as high a density as feasible, taking into consideration sources and cost of electrical current, resistance of the electrolysis medium, heat dissipation, effect upon yields, etc. Over broad ranges of current density, the density will not greatly affect the yield. While very low densities are operable, suitable ranges for efficient operation will generally be in ranges from a few amperes/square decimeter of cathode surface, up to 10 or 100 or more amperes/dm$^2$. It is often advantageous to select the current with proper relationship to the olefin addition rate to react the olefin at the same rate as added and thus to maintain a desired cathode potential.

The present electrolysis can be conducted in the various types of electrolysis cells known to the art. In general such cells comprise a container made of material capable of resisting action of electrolytes, e.g., glass or plastics, and a cathode and anode, which are electrically connected to sources of electric current. The anode can be of any electrode material so long as it is relatively inert under the reaction conditions. Ordinarily the anode will have little or no influence on the course of the electrolysis, and can be selected so as to minimize expense and any corrosion, or erosion problem. However, there is a possibility of some interference from oxidation reactions, and this can be minimized by use of anodes other than platinum or carbon, for example by use of stainless steel or lead. Such precautions may be unnecessary in view of the fact that water in the electrolysis gives a non-interfering reaction product. Any suitable material can be employed as the cathode, various metals, alloys, graphite, etc., being known to the art. However, the cathode materials can have some effect upon the case and efficiency of the reaction. For example mercury, cadmium, lead and carbon cathodes are suitable. The half-wave discharge potential of olefinic compounds will vary with the electrode material, and ordinarily the electrolysis will be facilitated by employing electrodes in the lower ranges of discharge potentials. However, it should be noted that performance of the materials can be greatly affected by surface characteristics, alloying, or impurities, e.g., stainless steel gives different half-wave potentials than iron.

In the present process a divided cell will often be employed, i.e., some separator will prevent the free flow of reactants between cathode and anode. Generally the separator is some mechanical barrier which is relatively inert to the electrolyte materials, e.g., a fritted glass filter, glass cloth, asbestos, porous polyvinyl chloride, etc. An ion exchange membrane can also be employed. The desired reactions will occur in an undivided cell, and this could have advantages for industrial production in that electrical resistance across a cell-divider is eliminated. An undivided cell is particularly feasible when water is present to give a non-interfering discharge at the anode.

When a divided cell is used, it will be possible to employ the same electrolysis medium on both the cathode and anode sides, or to employ different media. In some circumstances it may be advisable to employ a different anolyte, for economy of materials, lower electrical resistance, etc.

The electrolysis cell employed in the pro edural Examples herein is primarily for laboratory demonstration purposes. Production cells are usually designed with a view to the economics of the process, and characteristically have large electrode surfaces, and short distances between electrodes. The present process is suited to either batch or continuous operations. Continuous operations can involve recirculation of a flowing electrolyte stream, or streams, between electrodes, with continuous or intermittent sampling of the stream for product removal. Similarly, additional reactants can be added continuously or intermittently, and salt or other electrolyte components can be augmented, replenished, or removed as appropriate. In some cases it is advantageous to add the olefinic reactant at the rate at which it reacts and to have only a low concentration of such reactant present at any time, i.e., to have a high conversion of the olefinic reactant. Additional description of a suitable cell for continuous operation is set forth in U.S. Pat. No. 3,193,480 of Manuel M. Baizer et al.

The products obtained in the present process can be recovered by a variety of procedures. A chromatographic analysis has been largely used for convenient separation and identification in the procedural examples herein. However, for production purposes, a separation by distillation, extraction, or a combination of such procedures will probably by employed. Distillation can be employed if there is sufficient difference in boiling points of the solvents, reactants, and ester products. Most of the simple esters can be distilled without any extensive thermal decomposition. Most of the esters will tend to be soluble in organic phases, rather than aqueous phases, and extraction with organic solvents, such as n-hexanes or diethyl ether are often suitable. Methylene chloride can similarly be used. Treatment with acids or bases can also be used in separations, with due care being taken to avoid saponification of the ester, and noting that the ester will generally be in the organic phase, while salts of the acids may be in the aqueous phase. Olefinic reactant can be distilled from the catholyte and recycled to the electrolysis in continuous procedures.

The electrolysis can be conducted at ambient temperatures, or at higher or lower temperatures. If volatile materials are utilized, it may be desirable to avoid elevated temperatures so that the volatile reactant will not escape, and various cooling means can be used for this purpose in preference to pressure vessels. Cooling to ambient temperatures may be appropriate, but if desired temperatures down to 0° C or lower can be employed. The amount of cooling capacity needed for the desired degree of control will depend upon the cell resistance and the electrical current drawn. If desired cooling can be effected by permitting a component to reflux through a cooling condenser. Pressure can be employed to permit electrolysis at higher temperature with volatile reactants, but unnecessary employment of pressure is usually undesirable from an economic standpoint.

The present process involves a carboxylation reaction and therefore requires a source of the

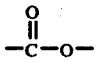

group, and carbon dioxide admirably serves this purpose. The carbon dioxide can be supplied at atmospheric pressure or at higher pressures, e.g., 50 or 100 atmospheres or more of carbon dioxide. Other sources can also be used, such as alkali metal carbonates, for example sodium bicarbonate, or various other materials equivalent to or a source of carbon dioxide or carbonic acid. The present invention contemplates reactions occurring in the presence of carbon dioxide regardless of its source. In utilizing the carbon dioxide under ambient conditions, there is no need to rigidly exclude other gases from the reaction, and when operating at atmospheric pressure some of the pressure may be due to the partial pressure of other gases present.

The following Examples are illustrative of the invention.

EXAMPLE 1

A mixture of acetonitrile, 16.7 ml, water, 2.1 ml, and acrylonitrile, 7.8 ml, was gradually added to 250 ml of electrolyte solution which was a 0.4 molar tetraethylammonium sulfate solution containing 2.5% water. Carbon dioxide was bubbled into the solution at one atmosphere and electrolysis was conducted at −2.12 cathode volts (versus saturated calomel electrode). The cell was a 500 ml flask with a stainless steel anode and a mercury cathode (64 $cm^2$ surface). The current varied from 0.3 to 0.5 ampere during the electrolysis which was conducted until 0.06 faraday of current was expended. Ethylether was added to the cell contents, and the aqueous layer was separated. The remaining ether/acetonitrile mixture was evaporated to leave as residue 2.05 grams of 3-cyanopropionic acid. This corresponds to a current efficiency of 70%.

EXAMPLE 2

An electrolysis of acrylonitrile was conducted utilizing a graphite anode and cadmium cathode. A small concentration of water was present in the acetonitrile electrolysis medium, along with $CO_2$. The initial 500 ml. solution contained 2% water and a 0.14 molar concentration of tetraethylammonium ethylsulfate. Additional water was added as a mixture with acetonitrile (20 grams/100 ml) at the rate of 5 ml of the the mixture per hour during the electrolysis. Acrylonitrile was added as a solution in acetonitrile (50 grams/100 ml) at the rate of 6 ml solution per hour after an initial addition of 2.7 grams acrylonitrile. For the 6 hour electrolysis a total of 6.1 grams water and 18.8 grams acrylonitrile were added. The electrolysis was conducted with an applied potential of 7 to 8.8 volts to maintain a constant current of 2.7 amperes. The electolysis temperature was approximately 5° C. Chromatographic analysis indicated 14.4 grams of cyanopropionic acid was produced for a 48% current efficiency based on the 16.2 ampere hours expended. About 1.5 grams of acrylonitrile was unreacted, and the yield of cyanopropionic acid was 38%. Analysis also indicated 0.4 gram of adiponitrile and 1.49 grams propionitrile. The chromatographic analysis is done on a column in the usual manner measuring retention time and peaks in comparison with known concentrations of the materials in solvents. Fluorinated silicone and free fatty acid phase on carbowax columns have been used. A trimethysilyl derivative of the cyanopropionic acid can be formed by reaction with chlorotrimethylsilane, and the amount of this derivative is similarly determined by chromatography.

Other olefinic reactants disclosed herein can be substituted in the foregoing procedures with similar results. The reduction potentials of such olefins will vary somewhat, but will in general be below, i.e., less negative, than that of carbon dioxide, and suitable for use in the illustrated procedures. Most of the olefinic compounds utilized herein will be characterized by a single polarographic half-wave reduction potential, but when the compound has two such potentials, the second or most negative is that referred-to herein unless otherwise specified. Compounds such as methacrylonitrile, methyl methacrylate, methyl trans-$\beta$-methoxyacrylate, methyl crotonate, etc., are subject to dicarboxylation upon electrolysis under anhydrous conditions, as is acrylonitrile, so the present procedure is useful for mono-carboxylating such compounds in the same manner as it is with respect to acrylonitrile. Acrylonitrile, for example when provided to an electrolysis at 0.45 grams/hour in dilute solution in acetonitrile, with a 0.12 to 0.4 ampere current, and potentiostated at −2.13 cathode volts, was converted to dimethyl 2-cyanosuccinate with 41% current efficiency. Methacrylonitrile under similar anhydrous conditions, 0.6 grams/hour, 0.7 ampere, and −2.27 volts, also gave the dicarboxylated product, dimethyl 2-cyano-2,3-propane dicarboxylate, with 28% current efficiency.

The carboxylated products produced in the present process can be readily interconverted from acid to salt or ester form, etc. The carboxyl functionability makes the products suitable for various purposes in known manner as intermediates. Many of the products are known compounds of known uses. The products in various forms are suitable as detergent builders and can be modified for such purpose by formation of various salts, or by formation if various esters or polyesters or ethers through reaction with glycols or other alcohols. Resinous polyesters suitable for coating or fiber forming uses can also be produced by usual ester forming reactions of the carboxyl products, in either ester or free acid form, with polyhydroxy compounds, with difunctional products being appropriate for production of linear polymers while less or greater functionability is useful where crosslinking is desired. The 3-cyanopropionic acid product can be hydrogenated and dehydrated to 2-pyrrolidone, which can be polymerized to a fiber-forming polyamide, nylon-4. Nylon-4 is useful for the textile and other applications for which commercial nylons are used.

What is claimed is:

1. The method of electrolytic carboxylation of alpha,beta-olefinic nitriles, esters and amides which comprises electrically reducing such olefinic compounds at the cathode, in an electrolysis medium comprising solvent and supporting electrolyte and in the presence of carbon dioxide and a small amount of water sufficient to direct the carboxylation substantially toward mono-carboxylation and recovering a product in which mono-carboxylation of the said olefinic compound has occurred.

2. The method of claim 1 in which a molecule of carbon dioxide has been added at the β-carbon atom.

3. The method of claim 1 in which the olefinic compound is acrylonitrile.

4. The method of claim 1 in which acrylonitrile is converted to β-cyanopropionic acid.

5. The method of claim 1 in which the olefinic compound is provided at approximately the rate it is reacted under the electrolysis conditions.

6. The method of claim 1 in which an undivided electrolysis cell is employed.

7. The method of claim 1 in which the electrolysis is conducted in an aprotic solvent containing a quaternary ammonium salt and 0.5 to 15% by weight water.

8. The method of claim 7 in which the olefinic compound is acrylonitrile and the product is β-cyanopropionic acid.

9. The method of claim 1 in which the cathode potential was controlled to a value sufficient for but not greatly differing from that needed for reduction of the olefinic compound under the electrolysis conditions.

10. The method of claim 1 in which the concentration of olefinic reactant is no more than 10 times that of carbon dioxide on a molar basis.

11. The method of claim 1 in which an aprotic solvent containing a supporting electrolyte salt and a small amount of water is used as the electrolysis medium and the concentration of olefinic reactant therein does not exceed 1 molar.

12. The method of claim 1 in which the cathode is lead and the solvent is acetonitrile.

13. The method of claim 1 in which the cathode is lead and the solvent is dimethylformamide.

* * * * *